US006769827B2

(12) United States Patent
Furukawa et al.

(10) Patent No.: US 6,769,827 B2
(45) Date of Patent: Aug. 3, 2004

(54) COLLECTOR TYPE WRITING IMPLEMENT

(75) Inventors: Kazuhiko Furukawa, Kouza-gun (JP); Yojiro Sano, Setagaya-ku (JP)

(73) Assignee: Mitsubishi Pencil Kabushiki Kaisha, Shinagawa-Ku (JP)

( * ) Notice: Subject to any disclaimer, the term of this patent is extended or adjusted under 35 U.S.C. 154(b) by 28 days.

(21) Appl. No.: 10/276,055

(22) PCT Filed: May 18, 2001

(86) PCT No.: PCT/JP01/04180

§ 371 (c)(1),
(2), (4) Date: Nov. 13, 2002

(87) PCT Pub. No.: WO01/87642

PCT Pub. Date: Nov. 22, 2001

(65) Prior Publication Data

US 2003/0180084 A1 Sep. 25, 2003

(30) Foreign Application Priority Data

May 18, 2000 (JP) ..... 2000-146608

(51) Int. Cl.[7] ..... B43K 5/18

(52) U.S. Cl. ..... 401/227; 401/198; 401/223; 401/224

(58) Field of Search ..... 401/188 A, 198, 401/224, 223, 225, 227, 228, 241, 242

(56) References Cited

U.S. PATENT DOCUMENTS 5,217,313 A * 6/1993 Tamura et al. ..... 401/227
5,427,463 A 6/1995 Bastiansen et al.
6,340,262 B1 1/2002 Komiya et al.
6,619,871 B2 * 9/2003 Furukawa et al. ..... 401/224

FOREIGN PATENT DOCUMENTS

| | | | |
|---|---|---|---|
| JP | 62-28465 | Y2 | 7/1987 |
| JP | 63-221096 | A | 9/1988 |
| JP | 1-10236 | Y2 | 3/1989 |
| JP | 13788/1993 | | 2/1993 |
| JP | 2517432 | Y2 | 8/1996 |
| JP | 2555094 | Y2 | 11/1997 |
| JP | 11-334276 | A | 12/1999 |
| WO | WO99/50079 | A1 | 10/1999 |

* cited by examiner

*Primary Examiner*—Tuan N. Nguyen
(74) *Attorney, Agent, or Firm*—Burns, Doane, Swecker & Mathis, L.L.P.

(57) ABSTRACT

In a free-ink type collector writing instrument, a collector (5) is formed with a passage hole (10) for providing commutation between the interior and the outside air so as to prevent the point assembly from being affected by the variation in inner pressure upon freezing or upon increase or decrease in pressure. At the same time, the passage hole is constructed in a shape so as not to present a stronger capillary attraction than that of an air/liquid exchanger (9) and than that of an ink feeder portion (3,6), whereby the problem of exudation leakage over time can be prevented.

16 Claims, 7 Drawing Sheets

COLLECTOR TYPE WRITING IMPLEMENT

TECHNICAL FIELD

The present invention is directed to improvement of free-ink collector type writing instruments, such as ball-point pens, felt tip pens, fountain pens and the like, having a writing tip as a writing element at the front end thereof, an ink tank for directly storing ink and a collector as a regulator for regulating the inner pressure by making use of capillary effect. In particular, the present invention relates to improvement against the problem of ink leakage from the writing tip due to frozen ink in freezing cold and while in use on an airplane and against the problem of natural ink flow-out.

BACKGROUND ART

There have been conventionally known writing instruments which have a collector between the point assembly and the ink tank for the purpose of keeping free-state ink by regulating the pressure inside the ink tank so as to prevent ink leakage from the writing tip and ink flooding through the air vent. The collector type writing instruments delivers an ample amount of ink equivalent to or greater than the initial state of sliver-type writing instruments, and have the advantages in that thick drawn lines can be drawn with little writing pressure without any gradual reduction in ink delivery until ink exhaustion, the ability to load an ample amount of ink, the ability of monitoring the remaining amount of free ink and other features.

However, the collector type writing instrument has the drawback that it has to be designed taking into consideration the problem of ink flooding, which might occur when increase and reduction in air pressure resulting from variations in temperature and pressure and change in height repeatedly occur. Conventionally, collector type writing instruments have been considered to be almost perfect if they can be used from room temperature about 20° C. to 50° C., which is the conceivable maximum temperature of the air. However, the problem of forward leakage, i.e., ink leakage from the pen tip, resulting from sharp increase and decrease in pressure when the pen is used on an airplane or resulting from a volume expansion occurring due to frozen ink under a storage environment in winter, e.g., −20° C. in arctic areas such as Northern Europe, Canada and the like, has come to be known.

This forward leakage problem due to freezing has, conventionally, been handled by increasing the amount of an antifreeze solution to the ink or by using special elements such as a tip rubber seal for the writing tip. Attempts to solve the problem with ink, in most cases, result in adverse influences on safety, drying performance of drawn lines, ink stability and the like. On the other hand, the attempt to solve the problem with a rubber seal, not only increases the parts cost and assembly cost but also causes a problem of the tip being constantly stained with ink by the rubber seal.

In order to solve this forward leakage problem, the applicant hereof has already proposed an invention disclosed in Japanese Patent Application Laid-open Hei 11 No. 334276 and others. In this invention, the forward leakage problem from the writing tip is solved by leading ink which is pushed out by volume expansion due to frozen ink at a temperature below 0° C. or sharp increase in temperature, from the collector interior to the collector exterior.

A collector type writing instrument is configured so that ink inside the ink tank is put into contact with an air exchanger hence the air exchanger is wetted with ink and the interior is isolated from the outside air other than at the air exchanger whereby ink or air is exchanged only through the air exchanger which presents a strong enough capillary attraction. Thus, the collector type writing instrument is a writing instrument using the mechanism that the meniscus created by the strong capillary attraction from the air exchanger, in effect, reduces the pressure inside the ink tank so that no ink will flow out from the tip of the point assembly when the tip is down.

As already mentioned in the preceding application, there has been known a defect. That is, once ink components leak out from the writing tip because of volume expansion due to freezing, they will never return from the writing tip after thawing, and are left as they have been spilt. Further, it was found that this freezing problem could be solved by providing a passage hole in the collector.

However, the preceding application only provides a simple passage hole, so that the following problems occur. That is, when the writing instrument is used under a high temperature high humidity environment or when the writing instrument has been left on a pen holder over long time with its pen tip down, ink oozes out from the passage hole over the passage of time, staining its appearance, or in the worst case, the collector retaining grooves below the passage hole alone are filled up with ink, causing ink to flood out through the air hole. There is also an exudation problem that ink spontaneously oozes and spreads out through the passage hole from the internal ink feed such as an pen core as an ink feeder portion.

Further, it was also found that when the writing instrument is used under a condition in which a sharp change in pressure occurs such as on an airplane, the pressure on the ink tank side acts on the ink and causes the ink to directly flood out in rush through both the air/liquid exchanger and passage hole, whereby ink flows out without making efficient use of the collector's surplus ink retaining function.

It is therefore an object of the present invention to make improvement of collector type writing instruments of a popular type. That is, it is an object to meet the demands for improvement of writing instruments in their accident prevention capabilities such as prevention against ink leakage caused by increase and decrease in the inner pressure of the ink tank resulting from change in temperature and change in air pressure and the like, prevention against ink flooding and forward leakage when they are stored at shops for long time and prevention against ink leakage due to freezing, to avoid crucial accidents such as pollution of consumer's clothes and to solve the above problems without degrading the excellent writing performance of the conventional collector type writing instruments without increase in cost.

DISCLOSURE OF INVENTION

The collector type writing instrument of the present invention to attain the above object is comprised of an ink feeder portion using the capillary attraction of an ink feed core (center core, collector core, collector itself with a slit, or the like) for assuring the flow path of ink from an ink tank to a writing point and a collector disposed between the ink tank of a cup-like shape having a bottom and the writing point for regulating the inner pressure by holding surplus ink utilizing capillary effect, and the examples include ball-point pens, felt-pens in which an ink feed core itself serves as a writing point, markers, fountain pens, small-tube writing instruments and the like.

In general, the collector has a vent portion connected to the outside air, a collector air groove and an air/liquid exchanger capable of allowing ink and air to move between the collector and the ink tank and capable of holding ink by a capillary attraction and is constructed so that air will not enter the ink tank except through the air/liquid exchanger by wetting the collector air/liquid exchanger. A typical collector is composed of a long narrow ink groove and a plurality of vanes radially arranged at appropriate intervals forming gaps or retaining grooves therebetween, so as to provide the function of regulating the inner pressure inside the writing instrument body by allowing ink to move into and out of the retaining grooves. Other than the above, a sliver made up of a fiber bundle, sponge may be used as a collector by subjecting it to an appropriate wettability adjusting treatment.

The first effective means of the present invention is characterized in that a passage hole is formed from the outer side surface of the collector toward the inner hollow of the collector, the passage hole being formed so as to present a smaller capillary attraction than that of the air/liquid exchanger and that of the feeder portion such as a center core. Simply, this configuration is constructed so that no ink will be drawn out from the collector inner hollow toward the outer side surface.

The reason why the capillary attraction of the passage hole is set to be smaller than that of the air/liquid exchanger is that if the capillary attraction of the passage hole is greater, ink is liable to move through the air/liquid exchanger when a sharp increase or decrease in pressure inside the ink tank occurs, hence the passage hole cannot be used efficiently, which easily leads to occurrence of ink flooding, ink leakage and other deficiencies. Reduction of the capillary attraction of the passage hole smaller than that of the feeder portion can be performed by enlargement of the passage hole, elimination of acute portions from the corners of the passage hole, elimination of grooves and projections in the interior wall of the passage hole and other methods.

Next, the effective means for supporting the first means will be itemized hereinbelow. The second effective means is characterized in that, in addition to the above means, the passage hole presents a smaller capillary attraction on the outer surface side of the collector than that on the inner surface side. Illustratively, the passage hole is constructed in a tapered configuration in which the bore diameter becomes greater from the inner side of the collector (on the inner hollow side) toward the outer side (outer side surface) or by making the curvature R of the corners on the inner side greater than that on the outer side.

The third effective means is characterized in that the collector is comprised of a plurality of vanes defining retaining grooves capable of holding surplus ink, and the passage hole is formed at one retaining groove located at a position more rearwards and closer to the ink tank side than the front most retaining groove (preferably at a retaining groove located more rearwards, by skipping one or more grooves, from the front most one to the ink tank side).

The fourth effective means is characterized in that a clearance presenting a capillary attraction smaller than that of the air/liquid exchanger and greater than that of the passage hole is formed around the passage opening on the inner hollow side, between the collector inner wall and the feeder portion. In the case where the collector inner hollow incorporating the feeder portion is comprised of a small-diametric portion and a large-diametric portion located on the tip side, more frontward than the small-diametric portion, the following relationship between the strengths of capillary action can be created: (air/liquid exchanger)>(gap at the small-diametric portion)>(gap at the large-diametric portion)>(passage hole).

The fifth effective means is characterized in that the surface of the passage hole is formed so as to present less wettability with ink than the other part of the collector, by providing a different surface roughness, a different surface treatment or construction with a different material, from that of the other part of the collector. This configuration also provides the function of preventing ink leakage, similarly to the above configurations.

The transparent or translucent ink tank made up of synthetic resin for directly holding ink has the collector press-fitted therein so that ink will not leak out. The ink should contain 40% or more water or solvent as its base and have a relatively low viscosity of 2 to 100 mpa·s at normal temperature. There are different types of ink: dye ink which can be dissolved in the main solvent; and pigment ink in which as water resistant, light stable coloring agents, pigments such as carbon black, pseudo-organic pigments such as color-coated resin powders, aluminum or other metal powders, inorganic substances such as titanium oxide, mica, or glass fragments and the like, are dispersed. Ink which has been used in the conventional collector type writing instruments can be used. Ink is not particularly limited in the present invention, but ink which is based on an organic solvent such as alcohols, xylene, etc., can also be used for the present invention as long as it can provide the function of a collector type writing instrument.

BEST MODE FOR CARRYING OUT THE INVENTION

Figure 1:
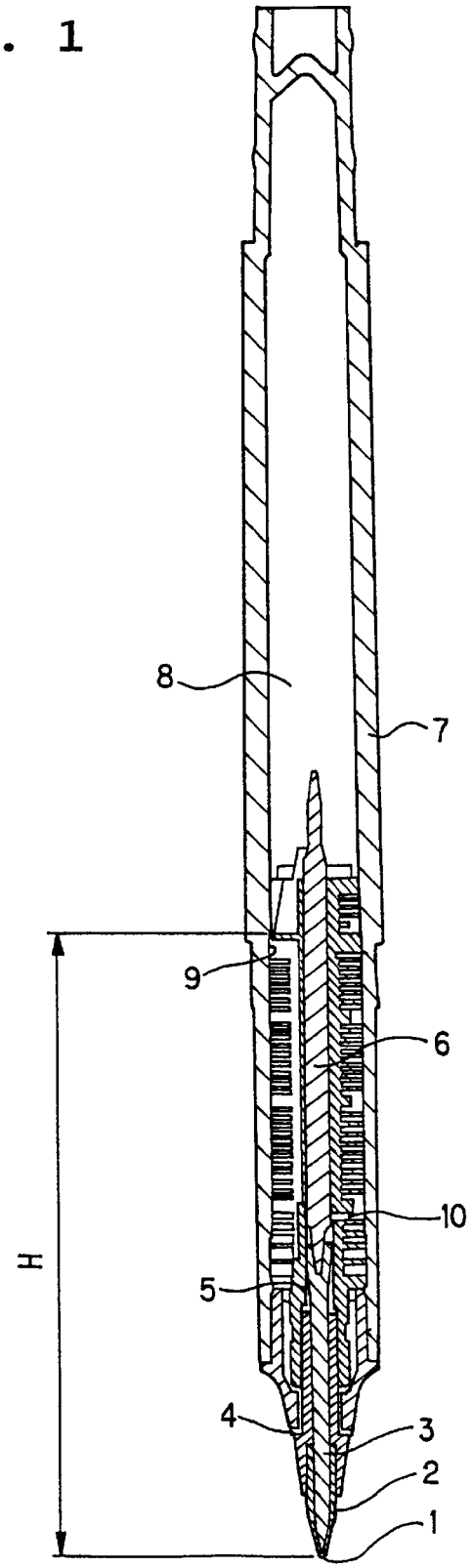
FIG. 1 is a vertical sectional view showing a writing instrument body of the first embodiment of the present invention.
Figure 2:
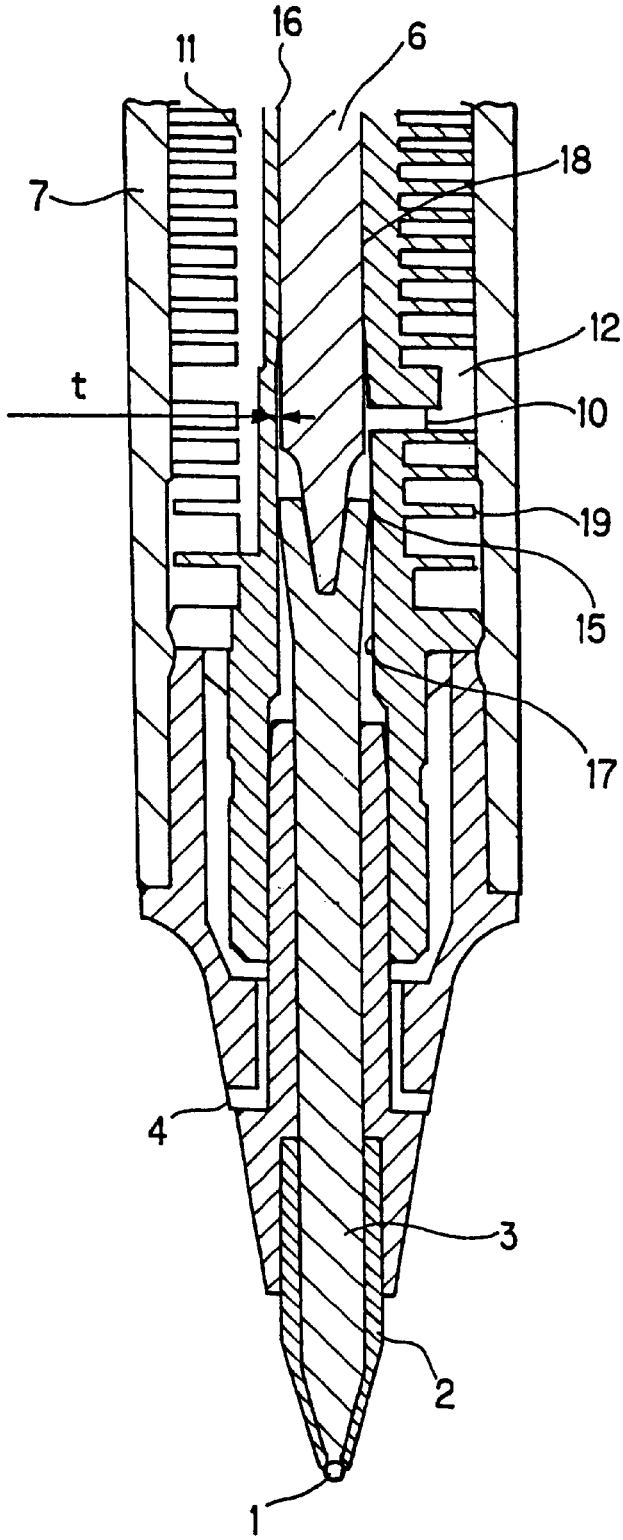
FIG. 2 is a detailed view showing the front end part of a writing instrument of the first embodiment of the present invention.
Figure 3:
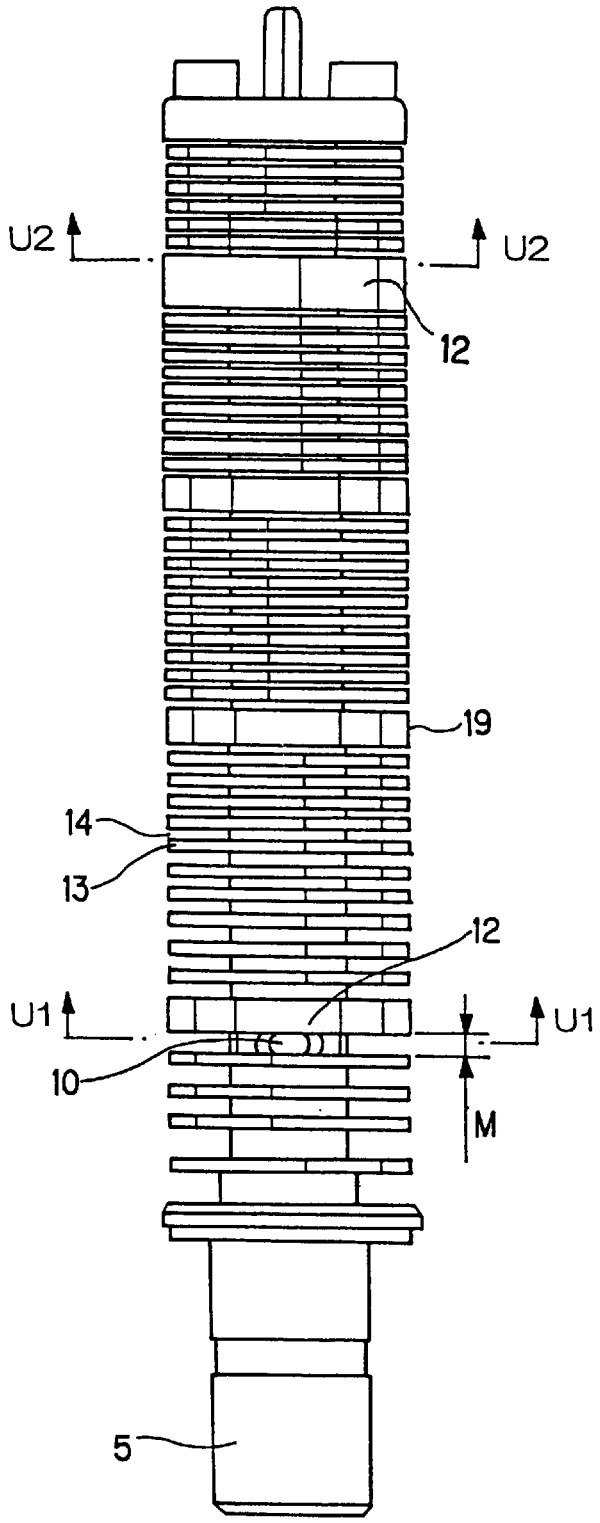
FIG. 3 is an external view of a collector as one embodiment of the present invention.
Figure 4:
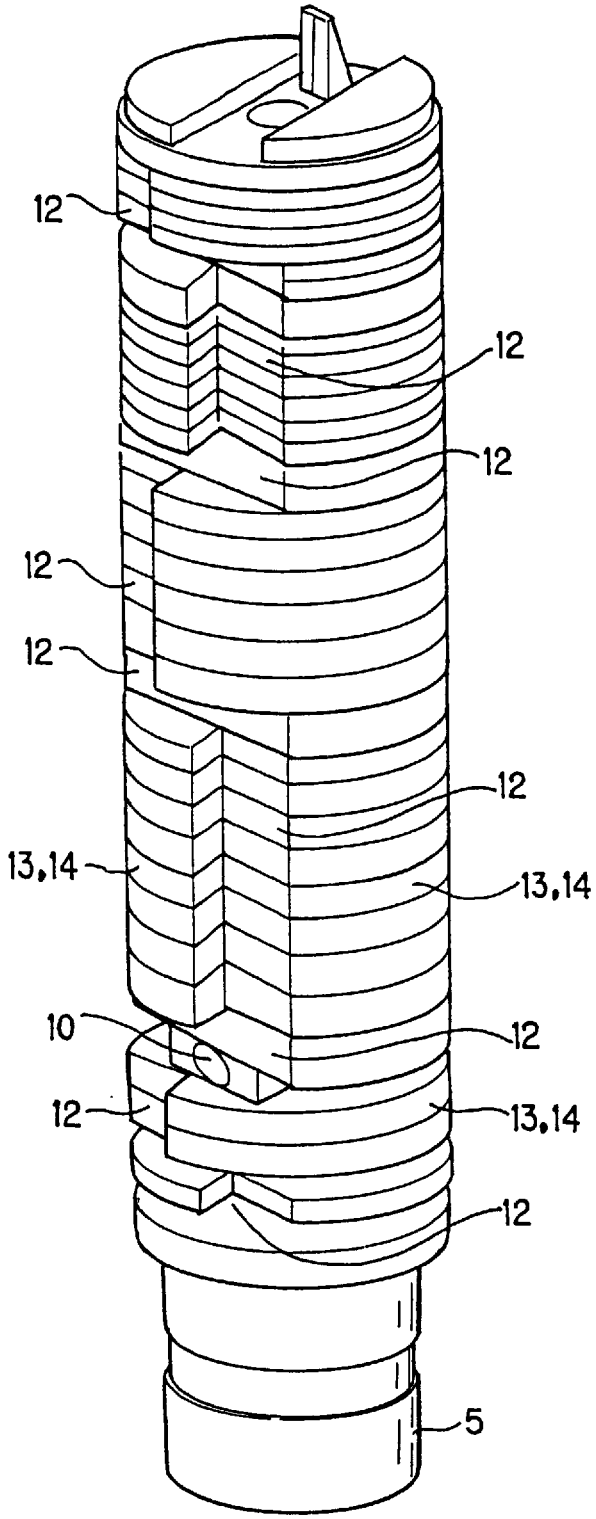
FIG. 4 is an external perspective view of a collector as one embodiment of the present invention.
Figure 5:
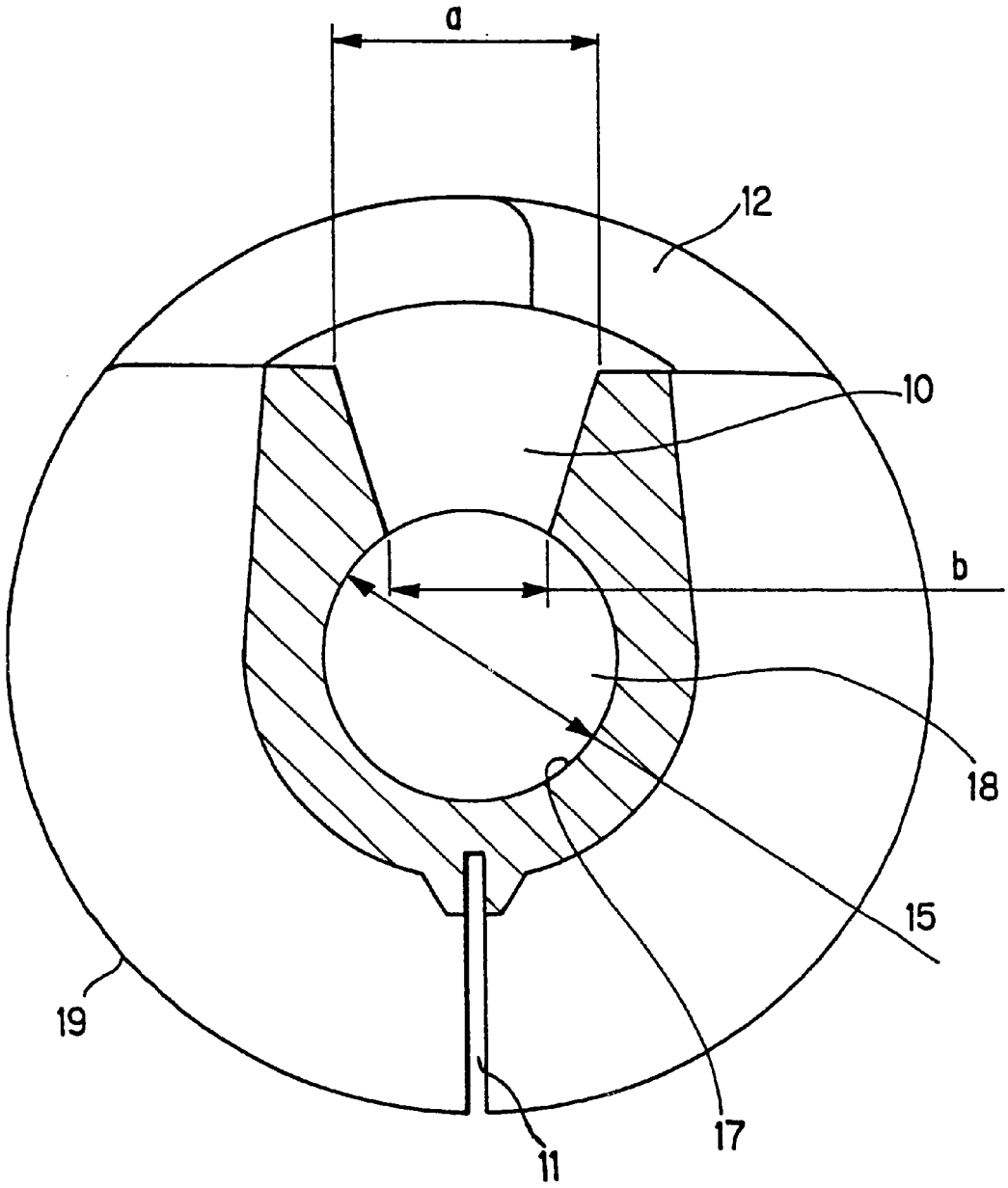
FIG. 5 is a cross-sectional view showing a passage hole portion of a collector as one embodiment of the present invention, taken on a plane U1-U1 in FIG. 3.
Figure 6:
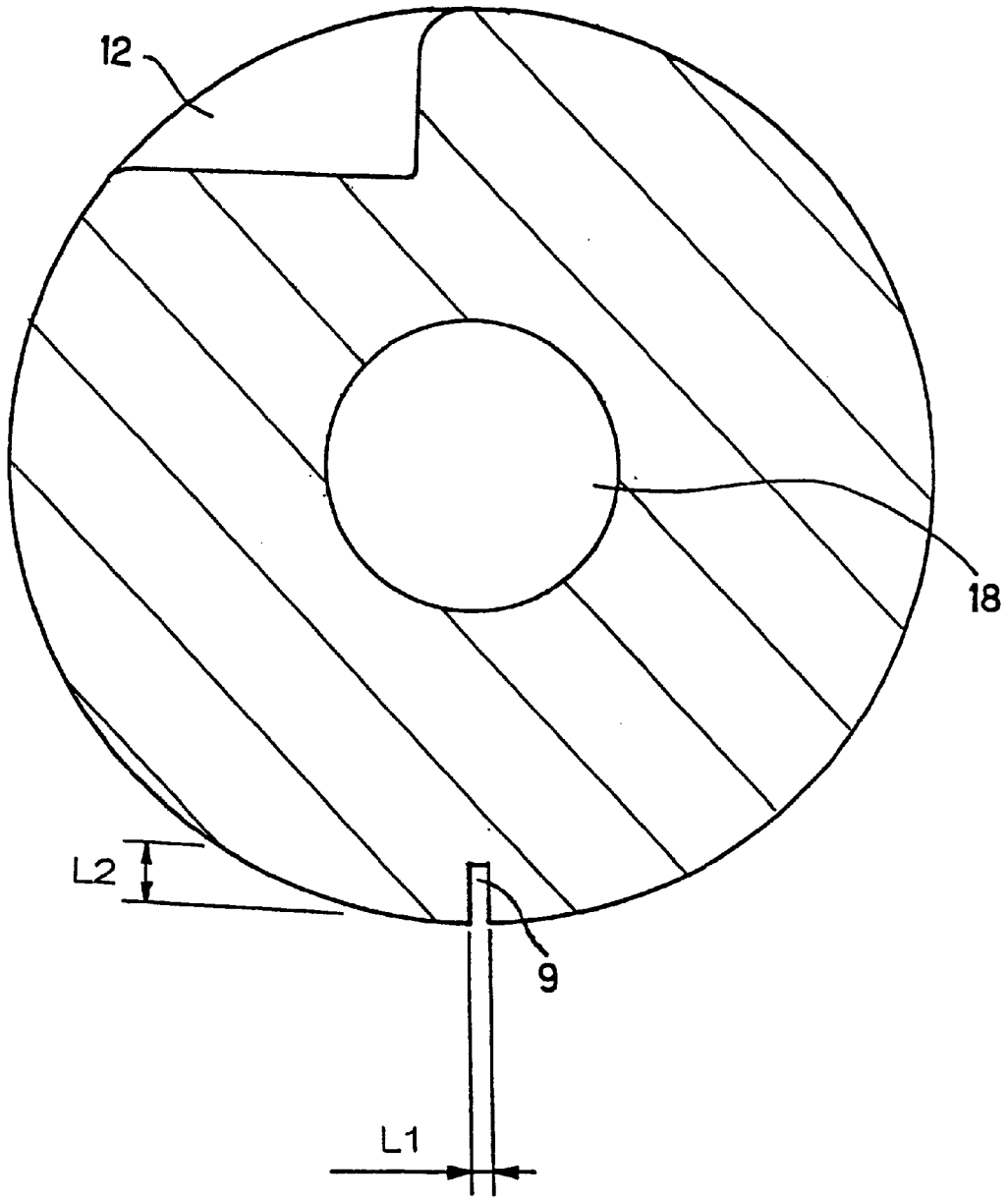
FIG. 6 is a cross-sectional view showing an air/liquid exchanger of a collector as one embodiment of the present invention, taken on a plane U2-U2 in FIG. 3.
Figure 7:
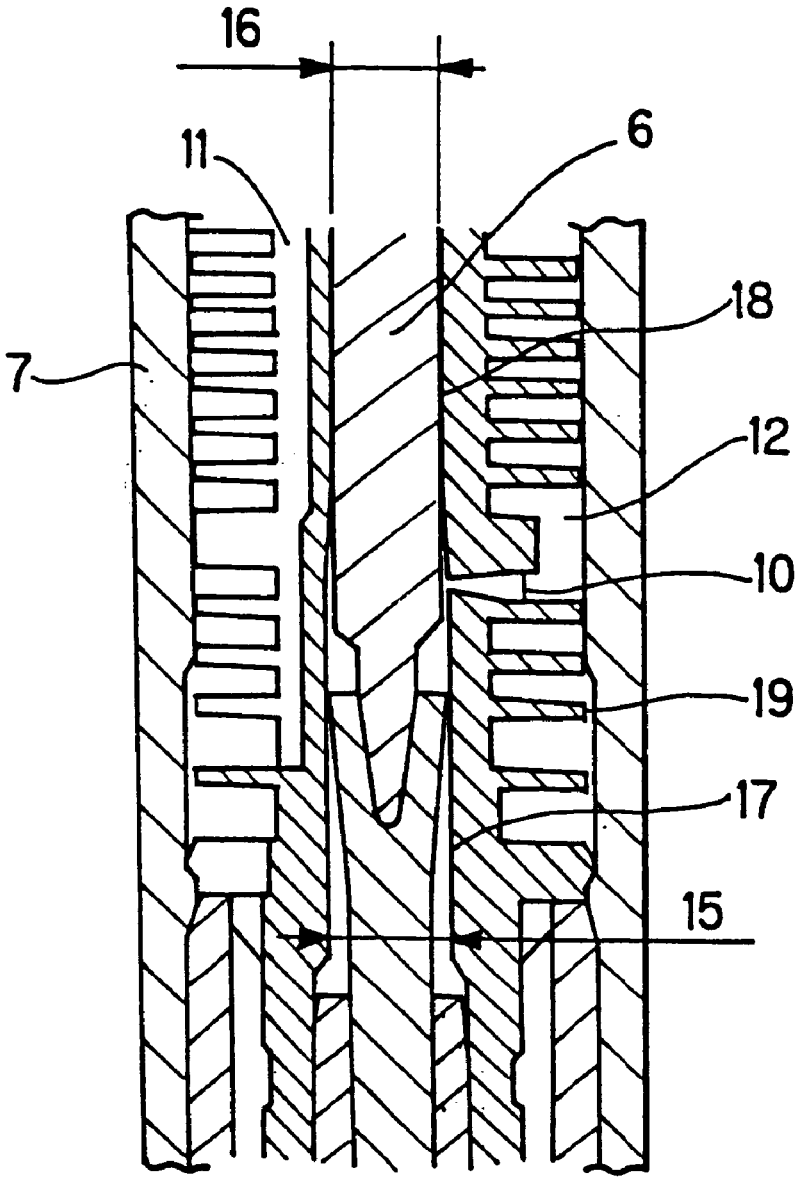
FIG. 7 is a vertical sectional view showing a passage hole portion of a collector of the second embodiment of the present invention.

The embodiments of the present invention will be described in detail with reference to the drawings. The drawings illustrate mere examples of the embodiments of the present invention. FIG. 1 is a vertical sectional view showing the overall configuration of a writing instrument body; FIG. 2 is an enlarged vertical section showing the front end part; FIG. 3 is an external view of a collector as a part; FIG. 4 is an external perspective view of a collector; FIG. 5 is a cross-sectional view showing a passage hole portion of a collector, taken on a plane U1—U1 in FIG. 3; FIG. 6 is a cross-sectional view showing an air/liquid exchanger of a collector, taken on a plane U2—U2 in FIG. 3; and FIG. 7 is a partly enlarged view showing a passage hole portion of the second embodiment.

Ink 8 used in a typical collector type writing instrument is composed of a main solvent such as water, alcoholic solvents and the like, in an amount of 40% or more, coloring agents such as dyes, pigments and the like, in an amount of 1 to 30%, a non-volatile solvent such as propylene glycol, glycerin, higher alcohols and the like, in an amount of 3 to 40% and lubricants, preservatives, dispersing agents and other additives. In the collector type writing instrument, ink 8 is stored in its free state in the rear part of an ink tank 7 and an air/liquid exchanger 9 which is constructed of a fine groove configuration and the like so as to present a strong capillary attraction is formed at around the rear end of a collector 5 and is wetted with ink 8 so as to provide sealing. Thus, the collector type writing instrument is configured so that air communication and leakage of ink 8 will not normally occur other than through air/liquid exchanger 9.

When a free-ink collector type writing instrument is exposed to an environment at a temperature of 0° C. or below, in most cases ink 8 begins freezing at a temperature from about 0° C. to −20° C. dependent on the composition of ink 8. In the case where freezing occurs, a component of the ink which is apt to solidify (water for water-based ink) becomes frozen and expands its volume while other components which have lower freezing points, e.g., solvent such as propylene glycol becomes concentrated in its liquid state and is pushed out, causing the fluid to leak from tip 1 of point assembly 2.

When the amount of ink left in ink tank 7 is reduced by ink consumption during writing to a level slightly greater than the maximum retention of collector 5, the variation in internal air pressure inside ink tank 7 becomes large. In this situation, if a change in internal pressure occurs resulting from the pressure difference between the inner pressure and atmospheric pressure due to increase or reduction in atmospheric pressure or resulting from a change in temperature, ink 8 may leak out from tip 1 of point assembly 2 to which flow passage of ink 8 for writing is established or air may enter through tip 1 causing ink starvation.

It has been found that the distance (head H) from tip 1 of the point assembly to air/liquid exchanger 9 of collector 5 cannot be designed to be equal to or greater than a certain height. When capillary attractions created by air/liquid exchanger 9 and retainer grooves 14 (FIG. 3) are set to be large (the sizes are set to be small), a strong meniscus is formed hence the inner pressure of ink tank 7 becomes lowered so that it is possible to increase the head H to a certain degree. However, if the inner pressure becomes too low, ink 8 for writing cannot be delivered, which causes ink starvation and other deficiencies. Usually, air/liquid exchanger 9 is constructed of a groove or hole having a size of about 0.05 mm to 0.2 mm or having a size corresponding to the pore size if collector 5 is made up of sponge or the like. Retaining grooves 14 are so constructed that the grooves on the ink tank 7 side are 0.1 to 0.4 mm wide and the grooves on the writing tip side are formed to be wider, about 0.2 to 1.5 mm wide.

When the relative inner pressure of ink tank 7 increases due to increase in external temperature, reduction in atmospheric pressure or any other reason, ink 8 inside ink tank 7 flows into retaining grooves 14 or the gaps between circular vanes 13 of collector 5, passing through air/liquid exchanger 9, and is retained therein, whereby the inner pressure is adapted to acquire a proper balance. Multiple retaining grooves 14 are connected to one another by an ink groove 11 which is connected air/liquid exchanger 9 so as to permit ink to flow.

When the relative inner pressure of ink tank 7 decreases due to reduction in external temperature, increase in atmospheric pressure, consumption of ink 8 for writing or any other reason, the inner pressure balance is taken by making ink 8 held in retaining grooves 14 of collector 5 return into ink tank 7 or leading the outside air into ink tank 7 if no ink 8 is held in retaining grooves 14. Thus, this mechanism makes it possible to store free-state ink 8 and permits smooth writing as well as preventing the accidental leaking out of ink 8 from the writing instrument during its normal usage. However, with normal collector type writing instruments, the mechanism is designed to exhibit its effect so as to deal with gentle pressure variation. Hence when a sharp increase or decrease in pressure occurs such as due to usage on an airplane, ink 8 may leak out from the tip of point assembly 2 or air may enter the interior of point assembly 2 causing ink starvation.

Even when the pressure variation is very gentle, if the writing instrument is kept in a low-temperature state below 0° C. where ink will freeze, ink 8 inside ink tank 7 and ink 8 around collector 5 freeze. In this case, the more freezable components such as water in the ink 8 compositions become frozen and cause volume expansion. In particular, ink tank 7 and the vicinity of the rear end of collector 5 are sealed other than air/liquid exchanger 9 which is of a minute size for forming a meniscus, ink 8 at air/liquid exchanger 9 as a shutoff portion which is in contact with the outside air is considered to become frozen first and the pressure inside the writing instrument increases as freezing continues up. Usual collector 5 adjusts the internal pressure by allowing ink 8 to move through air/liquid exchanger 9. However, since ink 8 becomes unable to move and is sealed, there occurs a problem that the unfrozen ink component is pushed out from tip 1 of point assembly 2 by way of collector core 6 and middle core 3 as the feeder portion, which is located at the center of the writing instrument and hence lags behind in freezing because of the temperature distribution.

As an embodiment of the present invention, conventionally known retaining grooves 14 providing the inner pressure regulating function are provided for collector 5 while a passage hole 10 which establishes communication between the outer surface of collector 5 and collector core 6 or center core 3 is formed at a position between the second groove, from the front tip side, and the fifth groove of retaining grooves 14 which are connected to ink groove 11, whereby ink 8 and air can be exchanged between the interior and exterior of collector 5. By this arrangement, it is possible to solve the short-term pollution problem of ink 8 due to freezing. In the present embodiment, the passage hole 10 is formed toward the large-diametric portion 15 of the inner hollow 18.

As has been proposed in the preceding application, provision of passage hole 10 in collector 5 is effective in relieving the pressure arising from freezing and acting on the point assembly 2 side, by leading the unfrozen component of ink 8 to retaining groves 14 of collector 5 by way of passage hole 10 which permits easy movement of ink 8 because it is located at a position shorter in distance than the point assembly 2 side is and because it has a greater size. However, provision of passage hole 10 of a simple configuration turned out to have a defect that ink 8 spontaneously flows out through passage hole 10 causing ink leakage from a vent 4 of the writing instrument when the writing instrument has been stored for a long period.

This problem is liable to occur when the passage hole is formed by merely aiming at penetration only, that is, with an ordinary hole with corners or with lengthwise stripes in the direction the metal mold is drawn. In particular, since the mold's lengthwise stripe problem will probably spontaneously arise when mass production is continued, some countermeasures are preferably taken from the design stage.

As the countermeasure against this problem, in the first embodiment of the present invention, the inner hollow 18 inside collector 5 for incorporating the ink feeder portion is formed of a small-diametric portion 16 at the rear end and large-diametric portion 15 in front of the small-diametric portion 16. That is, a clearance t is formed between the center core and the like as the ink feeder portion, designated at 3 and 6, and the collector inner wall 17 of collector 5 in the large diametric portion 15 near the inner side of passage hole 10 while the passage hole 10 is specified so as to present a smaller capillary attraction than any of air/liquid exchanger 9 and the center core or feed portions 3 and 6. Further, as specific examples of the embodiment, the corners of passage hole 10 may be rounded as shown in FIG. 3; or passage hole 10 may be formed in a tapered configuration in which the size of passage hole 10 becomes gradually greater from b on the inner side to a on the outer side, as shown in FIG. 5.

The passage hole 10 has a temporary pressure release function and forms a structure in which point assembly 2 is unlikely to be affected by variation in atmospheric pressure and by increase in pressure resulting from volume expansion due to freezing. If inner wall 17 of collector 5 and collector core 6 and the like as the ink feeder portion are in contact in the vicinity of the passage hole, the contact portion creates a fine clearance (presenting a strong capillary attraction) hence draws ink 8 from collector core 6 and the like, causing exudation leakage of ink 8 flowing forwards from the retaining groove 14 at which passage hole 10 is formed.

In the present embodiment, passage hole 10 is formed (with an axial width M (see FIG. 3 ) of 0.3 to 1.8 mm) so as to be greater than the size of air/liquid exchanger 9 (see FIGS. 1 and 6 ) having a circumferential width L1 of 0.1 to 0.3 mm and a radial length L2 (toward inner hollow 18) of 0.5 mm and it is formed without any corner so that it presents less capillary attraction than the inner feed core and the like. This arrangement was empirically proved to be able to prevent ink 8 from being drawn out through passage hole 10. Similarly, when large-diametric portion 15 is formed in inner hollow 18 so as to create clearance t from itself to collector core 6 (which is preferably 0.05 mm to 0.4 mm and presents a greater capillary attraction than passage hole 10 ), it is possible to make ink 8 unlikely to flow to the collector exterior surface 19 side. Accordingly, this arrangement has the function of preventing exudation leakage and smoothly returning the ink to the inner side if ink 8 was pushed out into retaining grooves 14 of collector 5. In connection with this, the capillary attraction of air/liquid exchanger 9 and that of passage hole 10 usually vary depending on their minimum width. In general, the greater the minimum width, the greater is the capillary attraction.

Since passage hole 10, if it has corners, cuts or other marks which will generate capillarity, on its surface causes deficiencies, no acute portion, no groove or no projection is formed in passage hole 10. In addition, the passage hole may be formed in a tapered configuration so that its outer side positively presents weaker capillarity than the inner side; the surface roughness may be reduced so as to adjust the wettability; a surface treatment with silicone oil or fluorores in may be performed so that the surface will be less wettable; plasma treatment or chemical treatment for enhancing the wettability may be performed other than the portion of passage hole 10; a wettability enhancement treatment may be performed first and punching, drilling or any other machining may be effected so as to create passage hole 10 by exposure of an untreated surface; and coating or a separate part may be used so that the surface will be less wettable. These are all effective.

The configuration of example 1 has the precedently known effects as follows: the effect of preventing leakage of ink 8 from point assembly 2 upon a sudden generation of pressure inside point assembly 2 when a sharp reduction in atmospheric pressure occurs as in use on an airplane; and the effect of making it unlikely to cause ink starvation and other deficiencies due to air entrance into point assembly 2 when a sharp increase in atmospheric pressure occurs. Further, this configuration also has the effect of promoting the ink 8, which has been pushed out through passage hole 10 and is held in retaining grooves 14, by virtue of the specified capillary relationship, to smoothly return to the collector core 6 side by way of passage hole 10 so as to be used for writing.

Further, since passage hole 10 is arranged at a position more rearwards (closer to the ink tank side) than the frontmost vane 13 (the point assembly side), this arrangement makes it possible to secure a large enough distance and space from vent 4 of the writing instrument, and hence further increases safety of the writing instrument by the ability of preventing leakage of ink 8 even if ink 8 has flowed out around passage hole 10 upon freezing or upon a reduction in pressure. In order to permit ink 8 to readily enter and get out of retaining grooves 14, an air groove 12 is provided. In the present embodiment, this air groove 12 is provided in a zigzag manner (see FIGS. 3 and 4). When passage hole 10 is formed at a turning point of the air groove 12, the risk of leakage can be further reduced.

As the second embodiment, when a passage hole 10 is provided in a tapered configuration as shown in FIG. 7, the same effects can be obtained. Further, in a case where collector 5 is composed of a sliver or sponge (not shown), passage hole 10 and other arrangements of the present invention can be configured in the same manner and the same effect can be obtained though a water repulsive treatment or the like is needed around vent 4 so that ink 8 will not flow thereto.

The collector type writing instrument of the present invention is configured as described heretofore, but the present invention should not be limited to the above embodiments and various features can be adopted without departing from the scope and sprit of the present invention. As the configurational examples unrelated to the features of the present invention, the ink tank barrel may be provided in a cartridge form; the refill may be integrally formed with the front barrel; a partially disposable configuration may be used; coloring may include transparent, opaque or glossy particles; the center core and collector core are integrally provided as a center core feeder or the like and a writing tip may also be integrally formed therewith; and point assembly parts and valve parts may be added. Particularly, various types of cap configurations can be selected.

The configuration and operation of the writing instrument of the present invention have been described heretofore. Accordingly, it is possible to provide a writing instrument which is slim and stylish and excellent in cost performance. It is also possible to suppress occurrence of deficiencies due to varying pressure in an airplane, variation in temperature including freezing, increase and decrease in pressure resulting from capping, and hence secure safe and stable writing performance. In particular, it is possible to provide a writing instrument which is free from problems if it is sold in arctic areas and free from accidents which would have occurred under conditions in which increase and reduction in pressure is repeated, such as in an airplane, as experienced by a businessperson who writes while traveling and who takes multiple flights.

Since the effects can be obtained without use of a special metal mold structure and without change in assembly method compared to the conventional collector type writing instruments, it is possible to provide a collector typewriting instrument which can be easily manufactured at the same parts cost, and which is cheap, stylish and excellent in long-term storage.

Industrial Applicability

The collector type writing instrument configuration of the present invention is suitable for a collector type writing instrument which is used under normal circumstances, under low-temperature circumstances in which ink may freeze and under conditions in which sharp increase and reduction in atmospheric pressure acting on the ink occur, such as in an airplane and the like.

What is claimed is:

1. A collector type writing instrument comprising: a point assembly having a writing point at the front end thereof; an ink tank for storing free-state, relatively low-viscosity ink having a viscosity of 2 to 100 mPa·s at normal temperature; a feeder portion for feeding ink from the ink tank to the writing point; and a collector as a regulator for regulating the internal pressure by making use of capillary effect, the collector type writing instrument further comprises an air/liquid exchanger capable of allowing ink and air to move between the collector and the ink tank and capable of holding ink by a capillary attraction, and a passage hole formed from an outer side surface of the collector toward an inner hollow of the collector, the passage hole being formed so as to present a smaller capillary attraction than that of an air/liquid exchanger and that of the feeder portion.

2. The collector type writing instrument according to claim 1, wherein the passage hole presents a smaller capillary attraction on the outer surface side of the collector than that on the inner hollow side.

3. The collector type writing instrument according to claim 2, wherein the collector is comprised of a plurality of vanes defining retaining grooves capable of holding surplus ink, and the passage hole is formed at one retaining groove located at a position more rearwards and closer to the ink tank side than the frontmost retaining groove.

4. The collector type writing instrument according to claim 3, wherein a clearance presenting a capillary attraction smaller than that of the air/liquid exchanger and greater than that of the passage hole is formed around the passage opening on the inner hollow side, between a collector inner wall and the feeder portion.

5. The collector type writing instrument according to claim 4, wherein the surface of the passage hole is formed so as to present less wettability with ink than the other part of the collector, by providing a different surface roughness, a different surface treatment or construction with a different material, from that of the other part of the collector.

6. The collector type writing instrument according to claim 3, wherein the surface of the passage hole is formed so as to present less wettability with ink than the other part of the collector, by providing a different surface roughness, a different surface treatment or construction with a different material, from that of the other part of the collector.

7. The collector type writing instrument according to claim 2, wherein a clearance presenting a capillary attraction smaller than that of the air/liquid exchanger and greater than that of the passage hole is formed around the passage opening on the inner hollow side, between a collector inner wall and the feeder portion.

8. The collector type writing instrument according to claim 7, wherein the surface of the passage hole is formed so as to present less wettability with ink than the other part of the collector, by providing a different surface roughness, a different surface treatment or construction with a different material, from that of the other part of the collector.

9. The collector type writing instrument according to claim 2, wherein the surface of the passage hole is formed so as to present less wettability with ink than the other part of the collector, by providing a different surface roughness, a different surface treatment or construction with a different material, from that of the other part of the collector.

10. The collector type writing instrument according to claim 1, wherein the collector is comprised of a plurality of vanes defining retaining grooves capable of holding surplus ink, and the passage hole is formed at one retaining groove located at a position more rearwards and closer to the ink tank side than the frontmost retaining groove.

11. The collector type writing instrument according to claim 10, wherein a clearance presenting a capillary attraction smaller than that of the air/liquid exchanger and greater than that of the passage hole is formed around the passage opening on the inner hollow side, between a collector inner wall and the feeder portion.

12. The collector type writing instrument according to claim 11, wherein the surface of the passage hole is formed so as to present less wettability with ink than the other part of the collector, by providing a different surface roughness, a different surface treatment or construction with a different material, from that of the other part of the collector.

13. The collector type writing instrument according to claim 10, wherein the surface of the passage hole is formed so as to present less wettability with ink than the other part of the collector, by providing a different surface roughness, a different surface treatment or construction with a different material, from that of the other part of the collector.

14. The collector type writing instrument according to claim 1, wherein a clearance presenting a capillary attraction smaller than that of the air/liquid exchanger and greater than that of the passage hole is formed around the passage opening on the inner hollow side, between a collector inner wall and the feeder portion.

15. The collector type writing instrument according to claim 14, wherein the surface of the passage hole is formed so as to present less wettability with ink than the other part of the collector, by providing a different surface roughness, a different surface treatment or construction with a different material, from that of the other part of the collector.

16. The collector type writing instrument according to claim 1, wherein the surface of the passage hole is formed so as to present less wettability with ink than the other part of the collector, by providing a different surface roughness, a different surface treatment or construction with a different material, from that of the other part of the collector.

* * * * *